US011622596B2

(12) United States Patent
Brown et al.

(10) Patent No.: US 11,622,596 B2
(45) **Date of Patent: *Apr. 11, 2023**

(54) FOOTWEAR FORCE MITIGATION ASSEMBLY

(71) Applicant: Worcester Polytechnic Institute, Worcester, MA (US)

(72) Inventors: Christopher A. Brown, Waterbury Center, VT (US); Winton Parker, Waitsfield, VT (US); James J. Muller, Worcester, MA (US); Abigale McAdams, Worcester, MA (US); Pedro D. Oporto, Worcester, MA (US); Josephine Bowen, Worcester, MA (US); Sarah Duquette, Spencer, MA (US); Eric Motler, Schenectady, NY (US); Tristin J. Carlton, Coventry, RI (US); Nicholas Workman, Worcester, MA (US); Michael Doyle, Worcester, MA (US); Jessica Shelsky, Worcester, MA (US); Jessica K. Y. Cheu, Worcester, MA (US); Lorenzo M. Dube, Worcester, MA (US); Olivia G. Steen, Worcester, MA (US); Andrew R. Vickery, Worcester, MA (US)

(73) Assignee: Worcester Polytechnic Institute, Worcester, MA (US)

( * ) Notice: Subject to any disclaimer, the term of this patent is extended or adjusted under 35 U.S.C. 154(b) by 166 days.

This patent is subject to a terminal disclaimer.

(21) Appl. No.: 16/592,868

(22) Filed: Oct. 4, 2019

(65) Prior Publication Data

US 2020/0100559 A1 Apr. 2, 2020

Related U.S. Application Data

(63) Continuation-in-part of application No. 15/675,989, filed on Aug. 14, 2017, now Pat. No. 10,888,138, (Continued)

(51) Int. Cl.
*A43B 13/18* (2006.01)
*A43B 7/148* (2022.01)
(Continued)

(52) U.S. Cl.
CPC ..... *A43B 7/148* (2013.01); *A43B 7/144* (2013.01); *A43B 7/1445* (2013.01);
(Continued)

(58) Field of Classification Search
CPC ..... A43B 13/18; A43B 13/186; A43B 5/02; A43B 13/12; A43B 13/122
(Continued)

(56) References Cited

U.S. PATENT DOCUMENTS 3,195,685 A 7/1965 Blackstone
3,251,144 A 5/1966 Weitzner
(Continued)

FOREIGN PATENT DOCUMENTS

GB 2 264 627 A 9/1993
GB 2492864 A 1/2013
(Continued)

OTHER PUBLICATIONS

International Search Report, PCT/US2019/054615, dated Dec. 10, 2019, pp. 2.

*Primary Examiner* — Marie D Bays
(74) *Attorney, Agent, or Firm* — Armis IP Law, LLC

(57) ABSTRACT

A force absorbing device for a footwear appliance includes a shoe upper and a shoe sole having a planar sole surface,
(Continued)

such that forces between the shoe upper and planar sole surface in ground contact are absorbed by force mitigation assemblies disposed in the shoe sole. A force mitigation assembly adapted for an athletic shoe includes a linkage to a wearer interface responsive to movement based on activity of the wearer. An attachment to a sole surface receives ground forces transmitted from frictional contact between the sole surface and a surface against which the sole is disposed, such as for running, turning, etc. A force mitigation assembly absorbs these forces received from the sole surface for directing the received force in a controlled manner. An elastic field in the force mitigation assembly is defined by a resilient material adapted to deform in response to the received force.

15 Claims, 11 Drawing Sheets

Related U.S. Application Data which is a continuation-in-part of application No. 13/860,877, filed on Apr. 11, 2013, now Pat. No. 9,730,486.

(60) Provisional application No. 62/741,795, filed on Oct. 5, 2018, provisional application No. 61/623,430, filed on Apr. 12, 2012.

(51) Int. Cl.
*A43B 13/12* (2006.01)
*A43B 7/1445* (2022.01)
*A43B 7/144* (2022.01)

(52) U.S. Cl.
CPC ..... *A43B 13/122* (2013.01); *A43B 13/185* (2013.01); *A43B 13/186* (2013.01)

(58) Field of Classification Search
USPC ..... 36/25 R, 134
See application file for complete search history.

(56) References Cited

U.S. PATENT DOCUMENTS 3,668,792 A 6/1972 York
3,707,047 A 12/1972 Zygmund
4,546,556 A 10/1985 Stubblefield
4,651,446 A 3/1987 Yukawa et al.
4,670,997 A 6/1987 Beekman
5,224,810 A * 7/1993 Pitkin ..... A43B 7/24 36/25 R
5,255,453 A 10/1993 Weiss
5,392,537 A * 2/1995 Goldberg ..... A43B 3/0042 36/115
5,456,027 A 10/1995 Tecchio et al.
5,502,901 A 4/1996 Brown
5,566,478 A * 10/1996 Forrester ..... A43B 3/0042 36/126
5,661,927 A 9/1997 Polowinczak et al.
5,692,323 A * 12/1997 Goldberg ..... A43B 3/0042 36/115
5,701,685 A 12/1997 Pezza
5,867,923 A * 2/1999 Lehneis ..... A43B 13/12 36/25 R
5,937,544 A 8/1999 Russell
6,327,795 B1 12/2001 Russell
6,378,169 B1 4/2002 Batten et al.
6,665,958 B2 12/2003 Goodwin
6,684,531 B2 2/2004 Rennex
6,701,645 B1 * 3/2004 Forrester ..... A43B 3/0042 36/126
7,013,581 B2 3/2006 Greene et al.
7,254,905 B2 8/2007 Dennison
7,334,349 B2 2/2008 Sokolowski et al.
7,487,606 B2 2/2009 Koo et al.
7,654,014 B1 * 2/2010 Moore ..... A43B 5/001 36/127
7,946,059 B2 5/2011 Borel
8,261,469 B2 9/2012 Aveni et al.
8,387,279 B2 3/2013 Pauk et al.
8,397,402 B2 * 3/2013 Lucas ..... A43B 13/181 36/28
8,771,157 B2 * 7/2014 Caponigro ..... A63B 23/0405 482/147
8,776,397 B2 7/2014 Borel et al.
9,339,074 B2 5/2016 Ellis
9,693,605 B2 7/2017 Beers
9,730,486 B2 * 8/2017 Brown ..... A43B 13/18
10,244,821 B2 4/2019 Elder et al.
10,888,138 B2 * 1/2021 Brown ..... A43B 13/203
2006/0032092 A1 * 2/2006 Drollinger ..... A43B 5/001 36/134
2007/0011919 A1 1/2007 Case, Jr. et al.
2007/0240331 A1 10/2007 Borel
2009/0113758 A1 5/2009 Nishiwaki et al.
2009/0235556 A1 9/2009 Reid
2009/0278707 A1 11/2009 Biggins et al.
2009/0284368 A1 11/2009 Case, Jr. et al.
2010/0077638 A1 4/2010 Simms
2010/0122471 A1 5/2010 Edington et al.
2012/0042540 A1 2/2012 Miner
2012/0079747 A1 4/2012 Seo
2015/0040435 A1 2/2015 Barnes et al.
2017/0325543 A1 11/2017 Iuchi et al.
2018/0042339 A1 2/2018 Barnes et al.
2018/0140043 A1 5/2018 Farris et al.
2018/0271211 A1 9/2018 Perrault et al.

FOREIGN PATENT DOCUMENTS

WO WO 2007/044451 A1 4/2007
WO 2011067768 A1 6/2011
WO 2012045512 A1 4/2012

* cited by examiner

FOOTWEAR FORCE MITIGATION ASSEMBLY

RELATED APPLICATIONS

This patent application claims the benefit under 35 U.S.C. § 119(e) of U.S. Provisional Patent App. No. 62/741,795 filed Oct. 5, 2018, entitled "TUNABLE STIFFNESS GOATS HEAD SPRING SYSTEMS," and is a Continuation-in-Part (CIP) of U.S. patent application Ser. No. 15/675,989, filed Aug. 14, 2017, entitled "SELF-RECOVERING IMPACT ABSORBING FOOTWEAR," which is a Continuation-in-Part (CIP) of U.S. patent application Ser. No. 13/860,877, now U.S. Pat. No. 9,730,486, filed Apr. 11, 2013, entitled "SELF-RECOVERING IMPACT ABSORBING FOOTWEAR," which claims the benefit under 35 U.S.C. § 119(e) of U.S. Provisional Patent App. No. 61/623,430, filed Apr. 12, 2012, entitled "SELF-RECOVERING IMPACT ABSORBING FOOTWEAR," all incorporated herein by reference in entirety.

BACKGROUND

Athletic injuries, such as from overstressed musculoskeletal structures, can be traumatic and career ending. ACL (anterior cruciate ligament) injuries are particularly notorious and prone to recurrence. These and other injuries often result from some form of loads (e.g., forces and torques) transferred through the footwear of the athlete to the foot and on to an anatomical member, such as, a bone, ligament, cartilage, tendon or other tissue structure. Mitigation of the transfer of these loads can substantially eliminate or alleviate injury risk to the foot, ankle, lower leg and knee. Because an athlete's footwear defines the ground interface, the footwear defines the focal point of potentially injurious load transfers. Shoe soles for athletic usage often employ high friction materials such as rubber and flexible polymers to "grip" the playing surface, and also employ a texture, ribs or protrusions on the bottom surface to avoid slipping. These materials and structures increase the load transfer from the athletes to the playing surface and when unmitigated, raise these loads an injury threshold.

Cushioning, padding and air bladders purport to distribute forces in conventional shoes, however these devices exhibit behavior similar to conventional springs. Most conventional mechanical springs have a single, consistent positive stiffness (force/displacement) throughout their deformation, e.g., stretching or compressing, until they reach the limit of their displacement, at which point the stiffness becomes fixed and substantially like a solid material. Conventional constant-force springs are characterized by large displacements, and low-forces, such as found for vacuum cleaner cords and tape measures. Constant-force springs are generally characterized by minimal variance or "cushioning" once the constant force is reached and displacement continues equivalent to the constant force.

SUMMARY

A force absorbing device for a footwear appliance includes a shoe upper and a shoe sole having a planar sole surface, such that forces between the shoe upper and planar sole surface in ground contact are absorbed by force mitigation assemblies disposed in the shoe sole. A force mitigation assembly adapted for a footwear appliance includes a linkage to a wearer interface responsive to movement based on activity of the wearer, typically defined by the shoe or sneaker upper that encapsulates the foot. An attachment to a sole surface receives ground forces transmitted from frictional contact between the sole surface and a surface against which the sole is disposed, such as for running, turning, etc. A force mitigation assembly in communication with the linkage and the attachment absorbs these forces received from the sole surface for directing the received force to the linkage in a controlled manner. An elastic field in the force mitigation assembly is defined by a resilient material adapted to deform in response to the received force.

Configurations herein are based, in part, on the observation that footwear often includes minimal force absorption material or structure, and that which is present conforms to a conventional spring response. Unfortunately, conventional approaches suffer from the shortcoming that the conventional spring response, having a substantially linear force/displacement curve, rapidly approaches a maximum displacement such that high impact forces are often transmitted to the wearer with little mitigation. Accordingly, configurations herein disclose a force mitigation assembly including an elastic field spring structure packaged for encapsulation in a shoe sole. The elastic field exhibits a flat response, rather than a displacement-proportional response, so that abrupt or impact loads are met with a constant force independent of displacement for absorbing sharp or peak loads that tend to be associated with injury.

Configurations disclosed herein present a force mitigation assembly including an elastic apparatus having an elongated deformable member wrapped around a pair of rigid posts perpendicular to the deformable member, such that the deformable member has substantially equal portions disposed around a circumference of the parallel posts. The parallel posts exhibit a constant size elastic field as the deformable member unwinds from the posts in response to a force exerted on the deformable member at a point between the parallel posts. The deformable member may include a plurality of adjacent deformable members, typically in a gridlike arrangement, such that each of the adjacent deformable members is adapted for independent, measurable deformation in response to the exerted force. Each of the deformable members is responsive to modification for effecting a resistive force in response to the received force.

Configurations disclosed herein proposed a redesigned sole of an athletic shoe with a mechanical system to prevent or reduce the occurrence of ACL injuries in athletes. There are three directions of forces which cause ACL tears in athletes; normal to the ground, shear along the x-axis and shear along the y-axis with the x- and y-axis determined to be parallel to the ground. The shear force directions are addressed with a multi-layered system in the sole of the shoe that allows additional motion in the shear directions.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The description below presents an example of a footwear appliance, or shoe, for implementing the disclosed force mitigation assembly using a constant force, or substantially constant force spring structure for mitigating harmful transmission of lateral and torsional (twisting) forces transmitted from shoe soles. The assembly including the constant force spring implements an elastic field approach where a counterforce is based on an area of the engaged elastic field, rather than a length of an elongated or contracted spring. The disclosed elastic field, constant force spring for exerting a linear force response is also applicable in alternate contexts without departing from the claimed approach.

Figure 1:
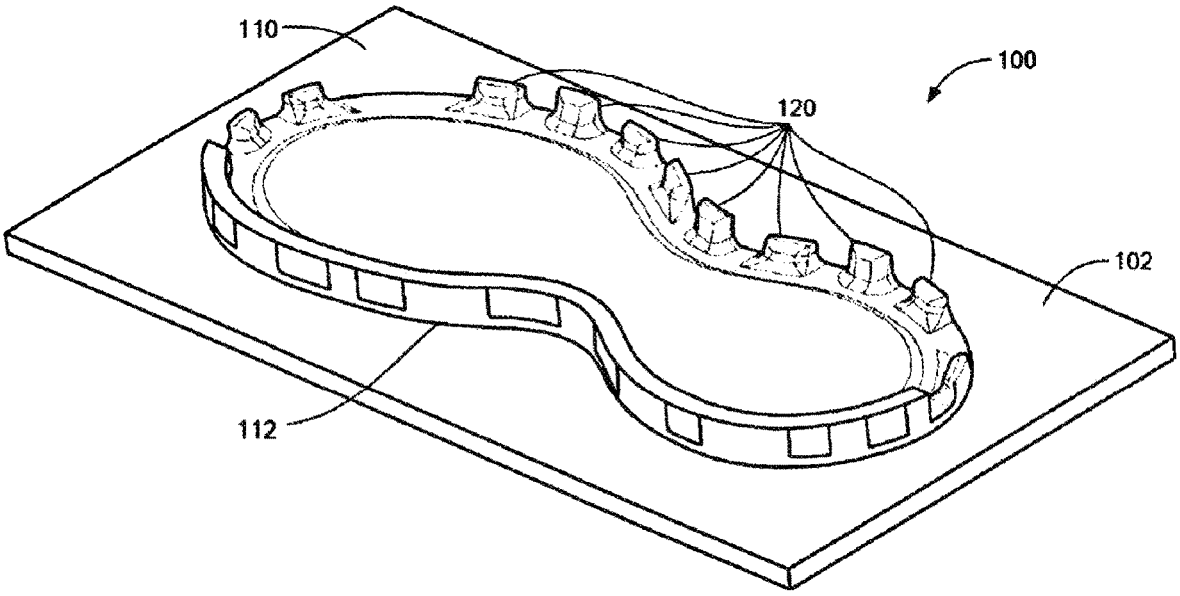
FIG. 1 is a perspective view of a perimeter-based shoe sole force mitigation approach.

FIG. 1 is a perspective view of a perimeter-based shoe sole force mitigation approach. In FIG. 1, a perspective view of a perimeter beam structure is shown in the form of resilient beams in a circumferential arrangement around a shoe sole surface. Referring to FIG. 1, a perimeter beam structure 100 includes a lower plane surface 110 having a plurality of beams 120 disposed around a perimeter 112 in the shape of a footwear appliance. Alternatively, varying lengths of beams may be employed, depending on the tier thresholds of desired response. The beams 120 extend orthogonally from the lower plane 110 and are adapted to slideably engage an upper plane discussed further below, and may be formed from a homogeneous molding 102 or sheet of resilient material from which a footwear shape may be cut.

Figure 2:
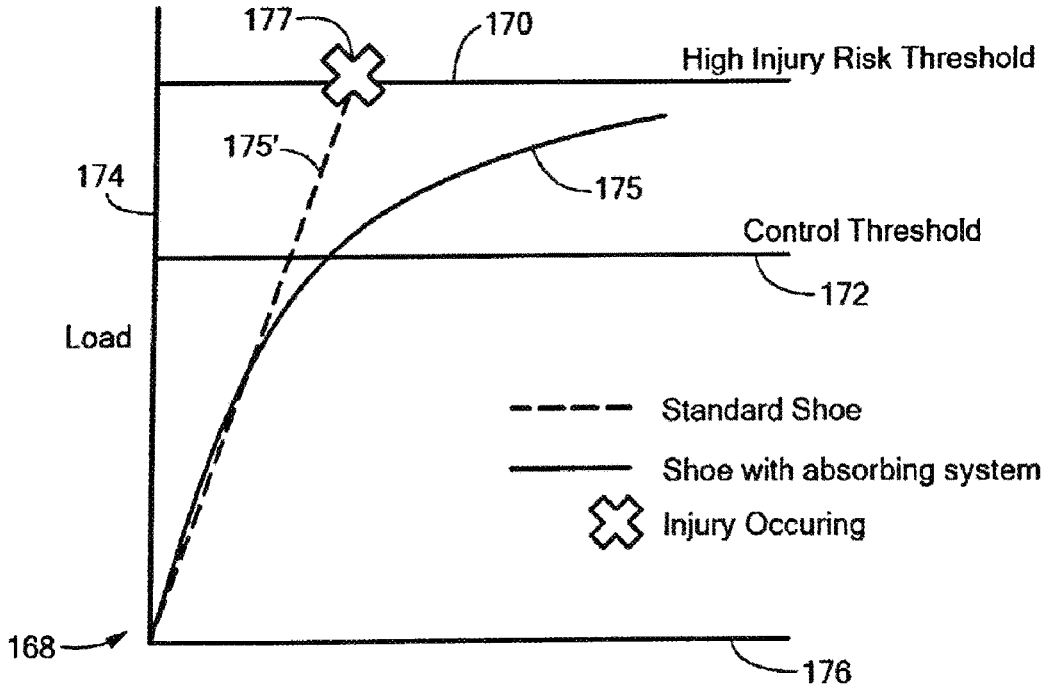
FIG. 2 is a force/performance graph of injurious forces mitigated by approaches herein.

FIG. 2 is a force/performance graph of injurious forces mitigated by approaches herein, and shows control and injury thresholds implemented in the configurations herein. Referring to FIGS. 1 and 2, a force graph 168 shows a relation between displacement force on vertical axis 174, and the relative displacement on a horizontal axis 176. The injury threshold 170 is defined by an excessive force of the shoe sole against the lower plane 110 (ground or playing surface), in which the excessive force transmits an undesirable level of force to a wearer interface. Although these thresholds are conceptual, and difficult to quantify, it should be apparent that high energy and contact sports impose forces between the footwear and playing surface as the wearer runs, changes direction, jumps, twists, etc. A normal level of force maintains a firm attachment of the sole to the playing surface. At some threshold, these forces become sufficient such that, if not mitigated, can cause injury by transferring that force to an anatomical structure such as an ankle or leg bone, muscle or tendon. These are the forces that the disclosed force mitigation assembly purports to address.

A control threshold 172 defines the point at which mitigation begins to occur. Continued force causes progressively greater displacement to avoid injury by mitigating the force short of the injury threshold 170. Mitigation is such that the lateral or forward movement less than the control threshold 172 is permitted and lateral movement greater than the control threshold 172 is absorbed by the force mitigation assemblies as shown by line 175 prior to forces attaining the injury threshold 170, shown by line 175,' until crossing the injury threshold at 177.

A shoe as defined herein includes any kind of footwear that is disposed between the foot of a wearer and the surface upon which it is deployed. Deployment, although athletic examples are depicted herein, may be any ambulatory activity such as walking, running, hiking, climbing or any usage that places the wearer's foot and ankle in a load bearing context with a floor, ground or playing surface. As will be apparent by the examples herein, the foot and ankle define a focal point of forces upon the skeletal frame of the wearer during any ambulatory activities, and are therefore a target of force mitigation as disclosed herein. In particular, configurations herein are particularly beneficial to high impact athletics because these activities generate forces that push an extreme threshold of human capacity. Substantial media attention has been directed to sports related injuries, particularly at the college and professional levels, and the resulting monetary aspects, both for rehabilitation and tortious omissions, has garnered the attention of sports management entities.

Figure 3:
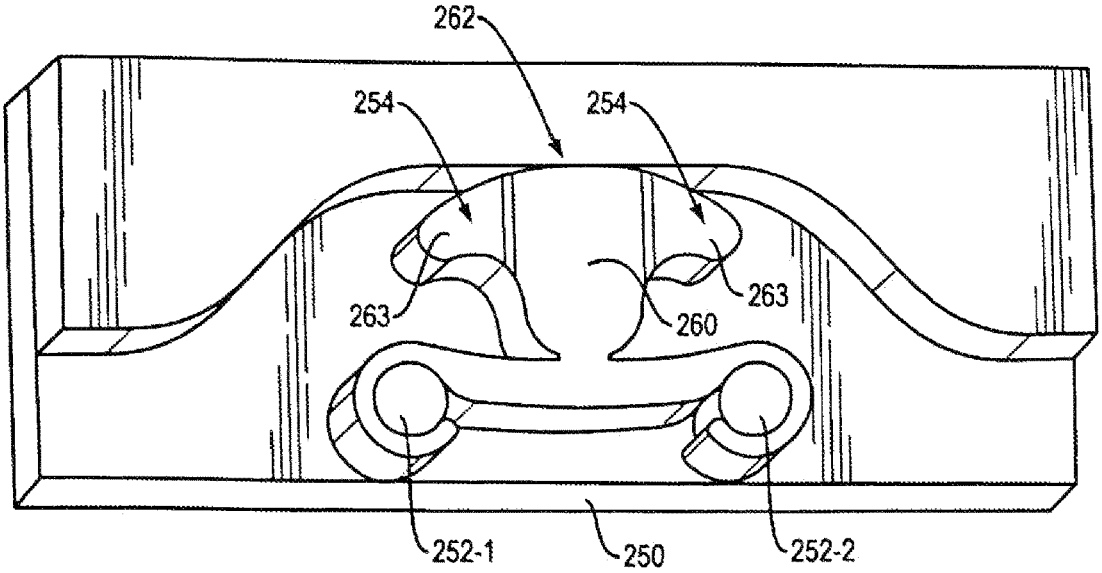
FIG. 3 shows an elastic field approach to force mitigation as defined herein.

FIG. 3 shows an elastic field approach to force mitigation as defined herein. FIG. 3 depicts an alternate arrangement disposed in an interior region of the sole, away from the perimeter. As an alternative to perimeter based resilient beams, an elongated deformable member having a 3-point articulation is employed. Referring to FIGS. 1-3, the impact absorbing structures include an elongated resilient member 250 extending between a plurality of uprights 252-1 . . . 252-2 (252 generally) extending orthogonally between upper and lower opposed planes, such that the elongated resilient member 250 is disposed for deflection in response to an opposing lateral force 254 between the upper and lower planes. The plurality of uprights 252, or posts, extend from either of the opposed upper and lower planes, and the elongated resilient member 250 further including a protrusion 260 adapted to engage a disposed surface 262 extending from the opposed plane. In other words, the uprights 252 attach to one shoe sole plane (upper or lower), the elongated resilient member 250 and protrusion 262 are secured to the uprights, and the disposed surface 262 extends from the opposed shoe sole plane. Wings 263 may extend from the protrusion 260 for dispersing forces.

Figure 4A:
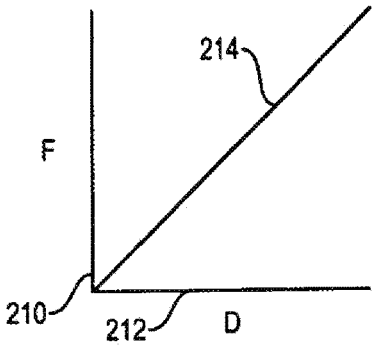
FIG. 4A (PRIOR ART)
FIGS. 4A-4B show a force mitigation curve implemented by the elastic field as in FIG. 3.
Figure 4B:
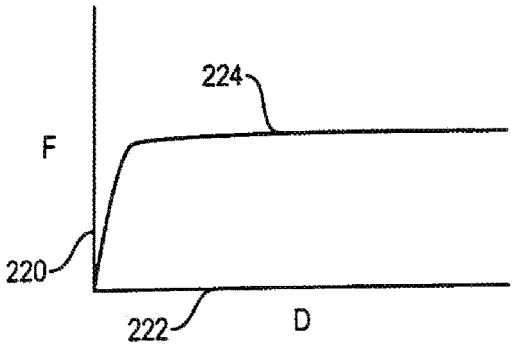
FIG. 4B (PRIOR ART)

FIGS. 4A and 4B shows a force mitigation curve implemented by the elastic field as in FIG. 3. FIG. 4A is a graph of prior art force displacement performance. In a conventional spring approach, a force 210 of an extended spring increases with the displacement 212 of the spring (line 214). An increasing level of force is required to continue displacement of an object connected to the spring, and a complementary return force is encountered upon release.

FIG. 4B is a graph of a constant force spring response as defined herein. An elastic field, in contrast to the spring of FIG. 2A, defines a constant force spring such that the force 220 required for displacement 222 remains substantially constant over the displacement distance, graphed as line 224 (following an initial compression period).

Figure 5A:
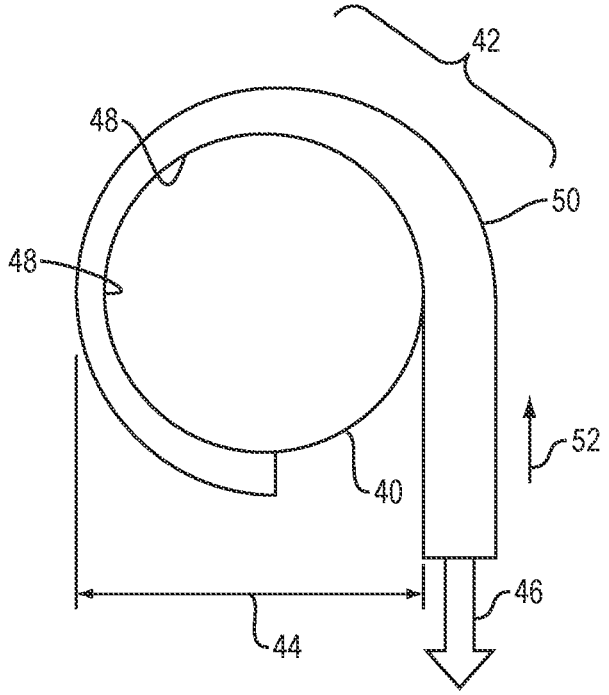
FIGS. 5A and 5B show constant and variable elastic fields for implementing a force mitigation curve as in FIG. 4B.
Figure 5B:
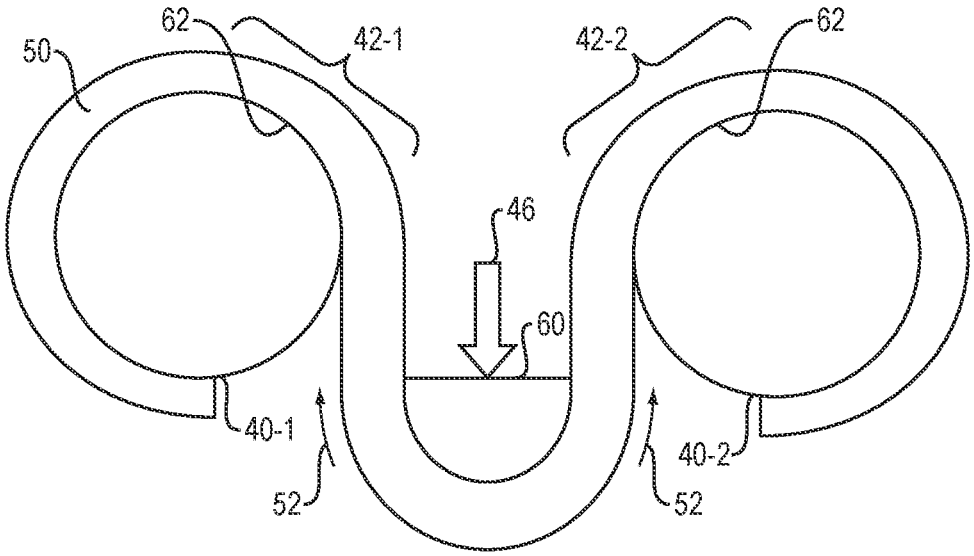

FIGS. 5A and 5B show constant and variable elastic fields for implementing a force mitigation curve as in FIG. 4. Referring to FIGS. 5A and 5B, an elongated member 50 formed of a resilient and/or deformable material is disposed around a rigid member 40 such as a cylindrical post. The elongated member 50 is pre-stressed or formed to have an undeformed or rest position corresponding to a diameter 44 of the cylindrical post. An actuation force shown by arrow 46 purports to draw the elongated member 50 around an annular surface 48 of the rigid member 40 by slideably disposing the elongated member 50 according to the actuation force. An elastic field 42 is defined by a segment or region of the elongated member that deforms from the rest position as it is "straightened" to follow the actuation force 46.

The elastic field 42 is therefore defined by a portion of the elongated member 50 deforming or compressing in response to the force 46. The resilient material, when disposed against the rigid member 40 extending from an attachment to a shoe sole surface adapted to deform the resilient material in response to a received actuation force 46, exerts a counterforce 52 against the deformation. Since a length of the elastic field 42 along the annular surface 48 remains substantially constant, a reactive force 52 imposed by the elastic field 42 remains substantially constant, in contrast to the conventional spring of FIG. 4.

FIG. 5B shows a dual post approach including two rigid members 40-1 . . . 40-2 (40 generally) flanking a central actuator 60. The elongated member 50 spans the plurality of rigid members 40, such that at least one rigid member extends from the linkage to the wearer interface, and the elongated member 50 is in slidable communication with at least two of the rigid members for deformation responsive to the received force. Each rigid member 40 has a corresponding elastic field 42-1 . . . 42-2 (42 generally) for responding uniformly to a received actuation force 46. In response to the received force, actuator 60 travel is mitigated by the reactive force 52 from the elongated member 50, which takes the form of dual spirals emanating from a central actuator and tends to have an appearance of a head of a goat with the spirals denoting horns.

The effect of the spiral biased around the post is that the elastic field 42 includes a deformation section 62 defined by a segment of the elongated member 50 in contact with the rigid member 40. The segment has a length that remains substantially constant during contact with the rigid member 40 while the elongated member 50 deforms to a straight position as it "unwinds" the spiral. In general, the rigid member 40 extends substantially perpendicular from the sole surface, and is coupled to the linkage for receiving the movement based on activity of the wearer. Some additional friction may be encountered by the length of the elongated member 50 remaining "wrapped" around the rigid member, but such friction can be minimized by appropriate material selection.

Different rigidity and cross section properties may be imparted to the elongated member 50 to vary the reactive force 52 in response to the received force direction 46, as the elongated member 50 is deformed out of a rest position from the bias around the post. The elongated member 50 is typically a homogeneous material with a solid cross section, such as nitinol or similar spring material.

Figure 6A:
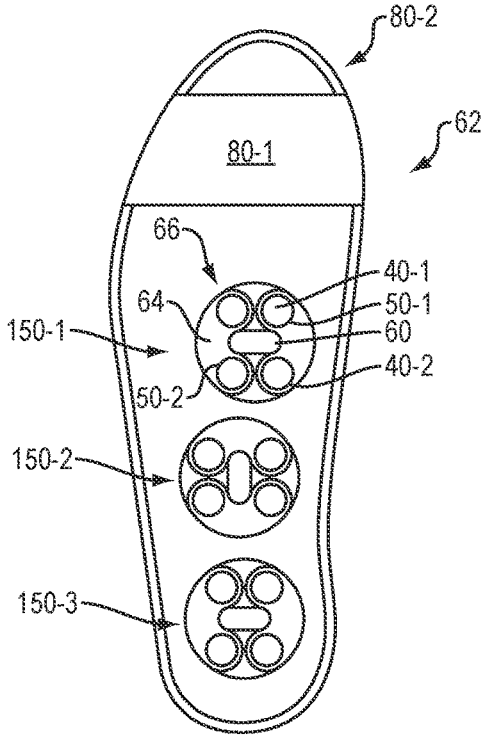
FIGS. 6A-6C show a plurality of force mitigation assemblies implemented in a shoe sole.
Figure 6B:
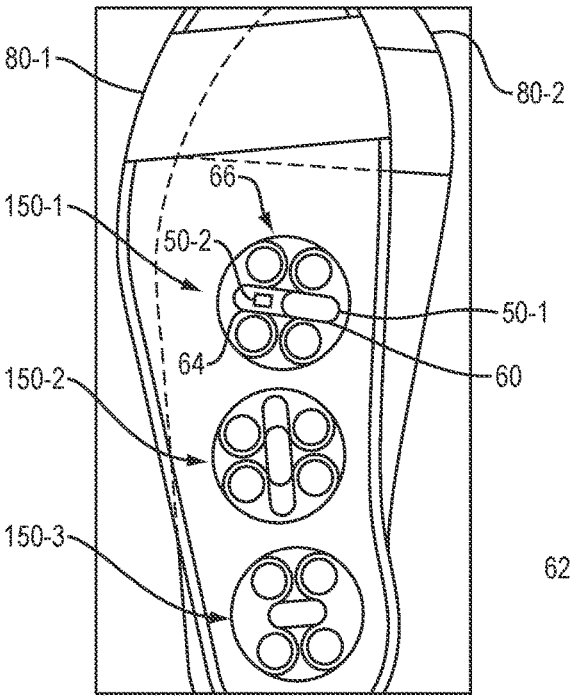
Figure 6C:
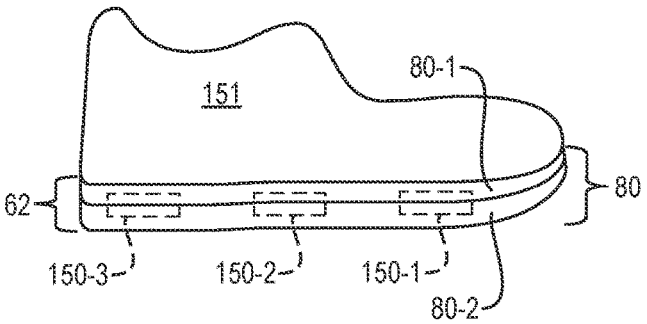

FIGS. 6A-6C show a plurality of force mitigation assemblies implemented in a shoe sole. Referring to FIGS. 5A-5B and 6A-6C, a plurality of force mitigation assemblies 150-1 . . . 150-3 may be included in a shoe sole for mitigating forces transmitted to a foot and ankle of a wearer through the shoe sole. A split sole architecture 62 includes an upper sole 80-1 and a lower sole 80-2 (sole plane 80 generally). The upper sole 80-1 provides a linkage to a wearer interface responsive to movement based on activity of the wearer, and the lower sole 80-2 defines an attachment to a sole surface for receiving ground forces transmitted from frictional contact between the sole surface and a surface against which the sole is disposed. The force mitigation assembly 150 is in communication with the linkage and the attachment for absorbing force received from the sole surface and directing the received force to the linkage in a controlled manner. The attachment is responsive to forces received from the sole surface, such that the received forces are substantially parallel to the ground surface during contact with the sole surface, as when the bottom surface of the shoe contacts the ground.

The dual post, "goat head" spiral arrangement is oriented in opposed pairs to define each force mitigation assembly 150, thus addressing opposed forces in either direction along one axis or component. Multiple force mitigation assemblies 150, therefore, can be arranged in perpendicular orientation to provide 360 degrees of coverage. For each spiral arrangement, therefore, the elongated member 50 is biased in a rest position around a perimeter of one or more of the rigid members 40 and adapted for slideable deformation in response to the received force. The elastic field 42 is defined by a portion of the elongated member 50 disposed around the perimeter of the rigid members 40. Each of the opposed elongated members 50-N absorbs a component of the received force in a direction opposite to the other of the opposed elongated member 50.

When disposed in a shoe assembly, the plurality of rigid members 40 are in communication between the linkage and the sole surface, such that each rigid member is coupled to either the linkage to the upper sole 80-1 or the sole surface, defined by lower sole 80-2. The elongated member engages each of the rigid members 40 and is biased in a rest position around at least one of the engaged rigid members (typically in pairs). This adapts the elongated member to slideably deform from the rest position in response to the received force.

Implementation of the force mitigation assembly on the interior of the sole body allows force mitigation to occur closer to an axis of twisting or rotary movements, and protects the force mitigation assemblies from impact and wear that may occur around the shoe perimeter. A plurality of force mitigation assemblies 150 may be employed in each shoe, and they may be positioned based on a component of motion absorbed by each device. In one configuration, discussed further below, three force mitigation assemblies are employed. A forward and rearward appliance both mitigate lateral forces to the left and the right. In the case of twisting forces, each would tend to mitigate an opposite direction of rotation. A center appliance mitigates forward and backward movement. Any suitable orientation of the force mitigation assemblies may be employed, as described below.

In the configuration of FIGS. 6A-6C, the elongated member 50 has an annular rest position slideably engaging flanking rigid members 40 extending from either the sole surface or the wearer interface. It should be apparent that the elongated member may be fixed to either the upper 80-1 or lower 80-2 sole plane as long as it is disposed in an interference path with an actuator 60 coupled to the opposed sole plane upon received forces tending to draw the upper and lower soles out of alignment. The actuator 60 therefore defines an actuating rigid member between the flanking rigid members 40, which are attached to the other of the sole surface or the wearer interface. The upper sole 80-1 defines the wearer interface and the sole surface defines the lower sole 80-2. An annular rest position disposes the elongated member 50 circumferentially engaged around the flanking rigid members 40 as the elongated member "wraps" around the annular surface. A received external force couples the actuating rigid member and the elongated member through interference, and is responsive to the received force 46 for deforming the elongated member 50 out of circumferential engagement with the flanking rigid members 40 as it is drawn around the annular surface.

Figure 7:
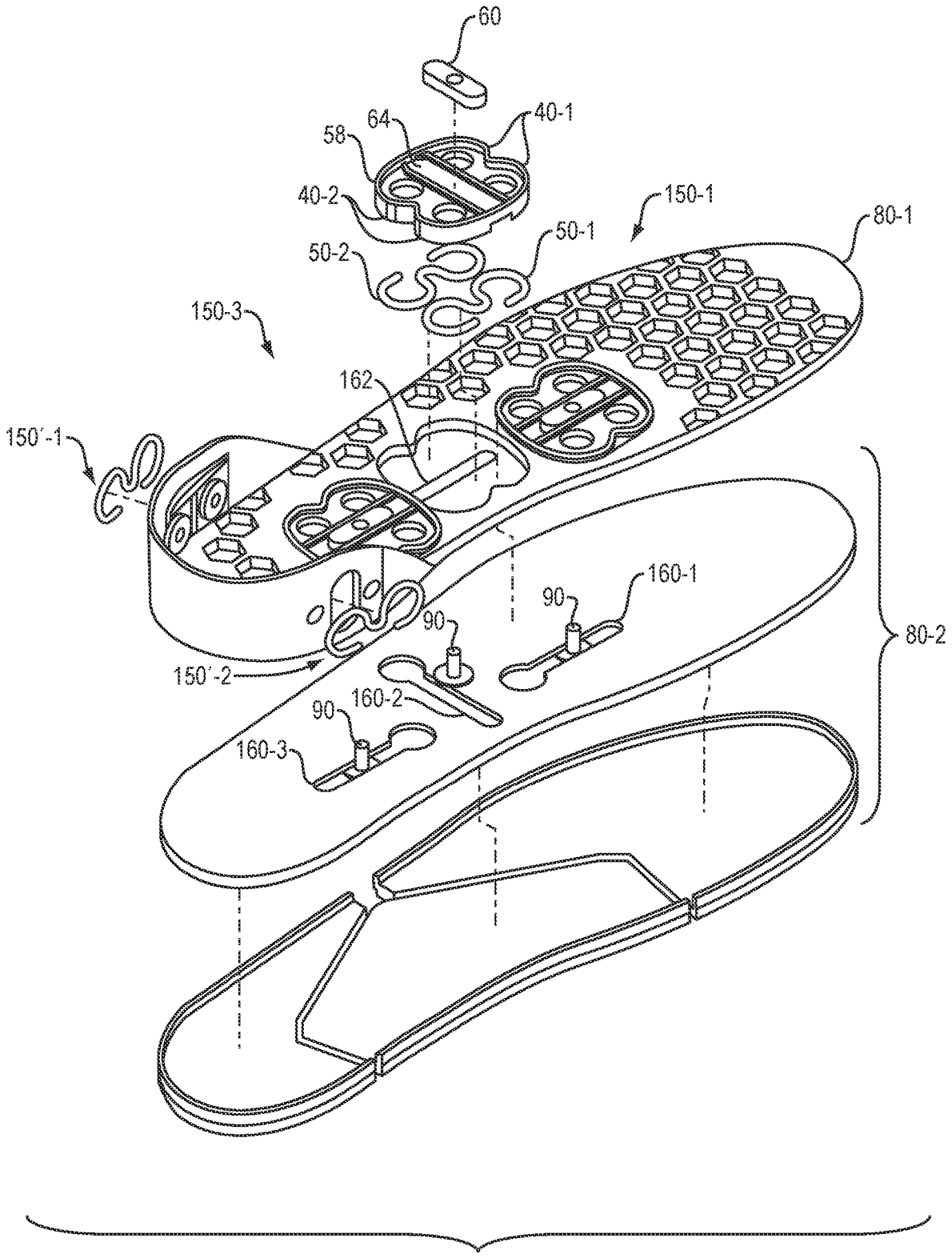
FIG. 7 shows an exploded view of a plurality of force mitigation assemblies in split or bifurcated shoe sole.

Each force mitigation assembly 150 includes an actuator 60 disposed in a slot 64 for mitigating a component of movement in its respective direction (forward or lateral), and allows independent movement in the other component. The three force mitigating appliances 150-N, in one example configuration, may be disposed around the heel and mid-section of the sole, leaving approximately a third on the front (toe) side open since twisting and axial forces tend to be defined by the ankle and vertical tibia/shin structures, and forward movement at the toe will still be transferred to the middle force mitigation assembly flanked by the lateral appliances, as now described with respect to FIGS. 6A-6C. Another configuration, shown in FIG. 7, depicts two forward/backward appliances flanking a central lateral-mitigating appliance. It should be apparent that various configurations of force mitigation may be distributed around the sole area.

Each force mitigation assembly 150 includes an elastic field 42 defined by a resilient material adapted to deform in response to the received force. The force mitigation assemblies 150 moderate and absorb forces from being transmitted from one sole plane 80 to the other. Each force mitigation assembly 150 is adapted to be installed in the upper 80-1 and lower 80-2 soles for absorbing forces between the sole planes 80.

Each force mitigation assembly includes opposed elongated members 50-1 . . . 50-2 each having a pair of flanking rigid members 40-1 . . . 40-2 and share a common actuator 60. An actuation slot 64 separates individual components of lateral and forward movement, and a circular cavity 66 allows rotation of a post assembly 68 to decouple lateral and forward movement components.

FIG. 6B shows the upper sole plane 80-1 drawn out of alignment with the lower sole plane 80-2 as the actuator 60 of the forward force mitigation assembly 150-1 actuates to the right. Center force mitigating assembly 150-2 is not required to dispose, while heel assembly 150-3 disposes slightly left as might occur in an ankle twisting movement.

FIG. 6C shows the sole planes 80 including the force mitigation assemblies 150-1 . . . 150-3 disposed for moderating the coplanar movement in a footwear article 151 (shoe). In contrast to the circumferential force mitigation beams shown in FIG. 1, an assembly 150 disposed in the sole is limited in height to avoid imposing excessive height constraints on the footwear. The elongated members 50 define an elastic field that is regulated by a cross section and resiliency of the material, rather than height. In other words, a compact elongated member 50 can achieve force mitigation via a wider, not necessarily taller, cross section, thus achieving an appropriate counterforce in a low profile suitable for mounting in a shoe sole.

FIG. 7 shows an exploded view of a plurality of force mitigation assemblies in a split or bifurcated shoe sole. Referring to FIGS. 5A-7, each force mitigation assembly 150 includes the opposed elongated members 50-1-50-2 engaged around rigid members 40-1-40-2 mounted in a base 58 and flanking the actuator 60. The actuator 60 is restrained in actuation slot 64, for mitigating force by the elongated members, lateral forces in this orientation. The actuator 60 is driven by a force transfer pin 90 that travels in a pin slot 160-1 . . . 160-3 (160 generally). The pin 90 slideably engages the pin slot 160-2 for transferring forces from the lower sole 80-2 to the upper sole 80-1, and which is aligned with the actuation slot 64. A component limiting slot 162 runs perpendicular to the actuation slot 64 and pin slot 160-2 for directing a component of the mitigated force to the component aligned with the actuation slot (lateral or forward). The component limiting slot 162 allows free movement in an unmitigated direction (forward, as shown) because that component will be picked up by one or both of the other force mitigation assemblies, 150-1 and 150-3.

Each force mitigation assembly 150 should tolerate movement in a direction or component other than the axis it is oriented to oppose or mitigate. An arrangement of slots and a pin attached to the actuator 60 allows decoupling of different components of movement. The pin allows mere sliding in directions other than that the force mitigation assembly is intended to oppose. Therefore, when multiple force mitigation assemblies are disposed together, as between the upper and lower soles 80, each avoids restricting movement in directions other than the one it is intended to oppose, allowing free 360 degree movement.

A vertically mounted elongated member 50' may also be employed to mitigate vertical heel forces.

FIGS. 8A-8D show top, perspective and exploded views of a plurality of force mitigation assemblies similar to FIGS. 6A and 6B directed to components of lateral and forward forces. Referring to FIGS. 7 and 8A-8D, the configuration of FIGS. 8A-8D discloses force mitigating assemblies 150-1 . . . 150-3 mounted in a circular void 66. The circular void 66 provides that the actuator slot 64 is disposed in a rotating base 68 and adapted to dispose in a direction corresponding to a component of the received force aligned with the slot 64. The circular void 64 allows rotation of the force mitigation assembly 150 to accommodate the forward and lateral components. Bushings 41 facilitate a rotational communication of the elongated members 50 with the rigid members 40 for relieving friction that may develop with a slideable communication. The actuation slot 64 guides the actuator 60, while the pin slot 160 in the lower sole 80-2 defines the component of movement addressed by the elongated members 50. In contrast to the configuration of FIG. 7, the component limiting slot 162 is effectively replaced by the rotation of the assembly 150 in the circular void 66.

Figure 8A:
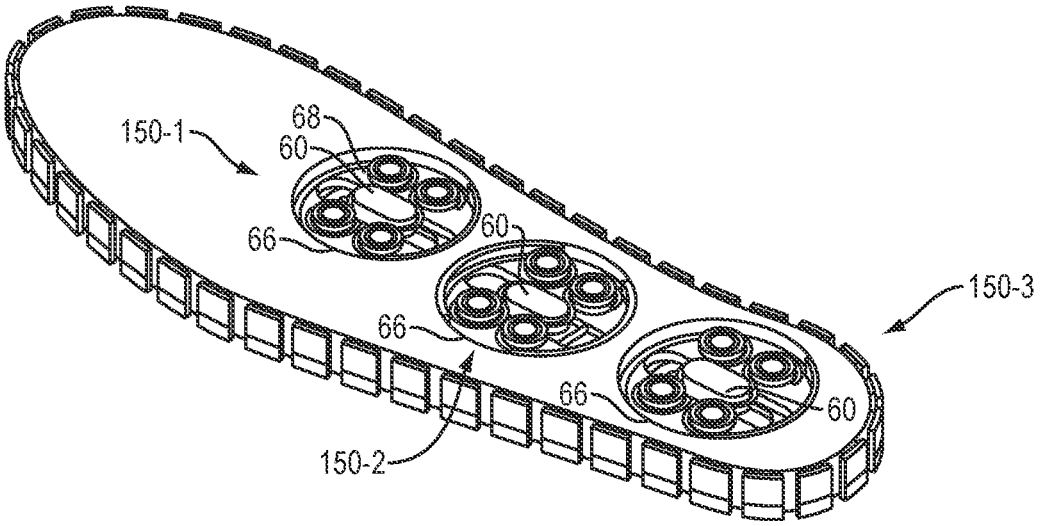
FIGS. 8A-8D show top, perspective and exploded views of a plurality of force mitigation assemblies directed to components of lateral and forward forces.
Figure 8B:
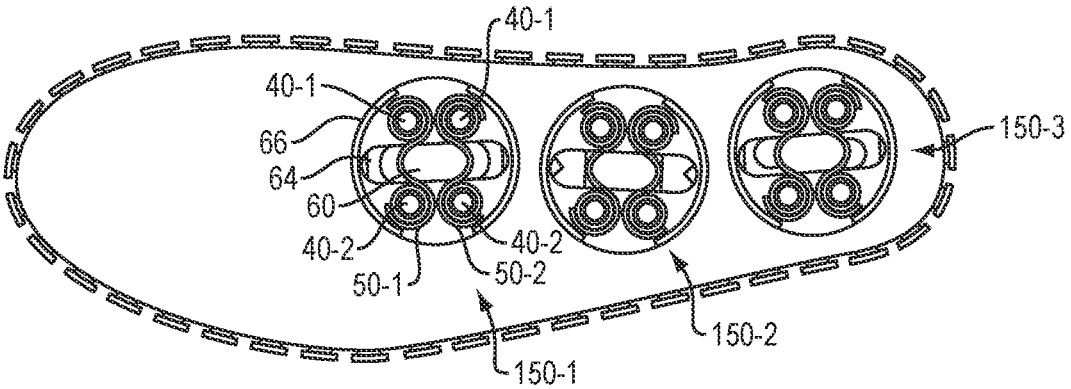
Figure 8C:
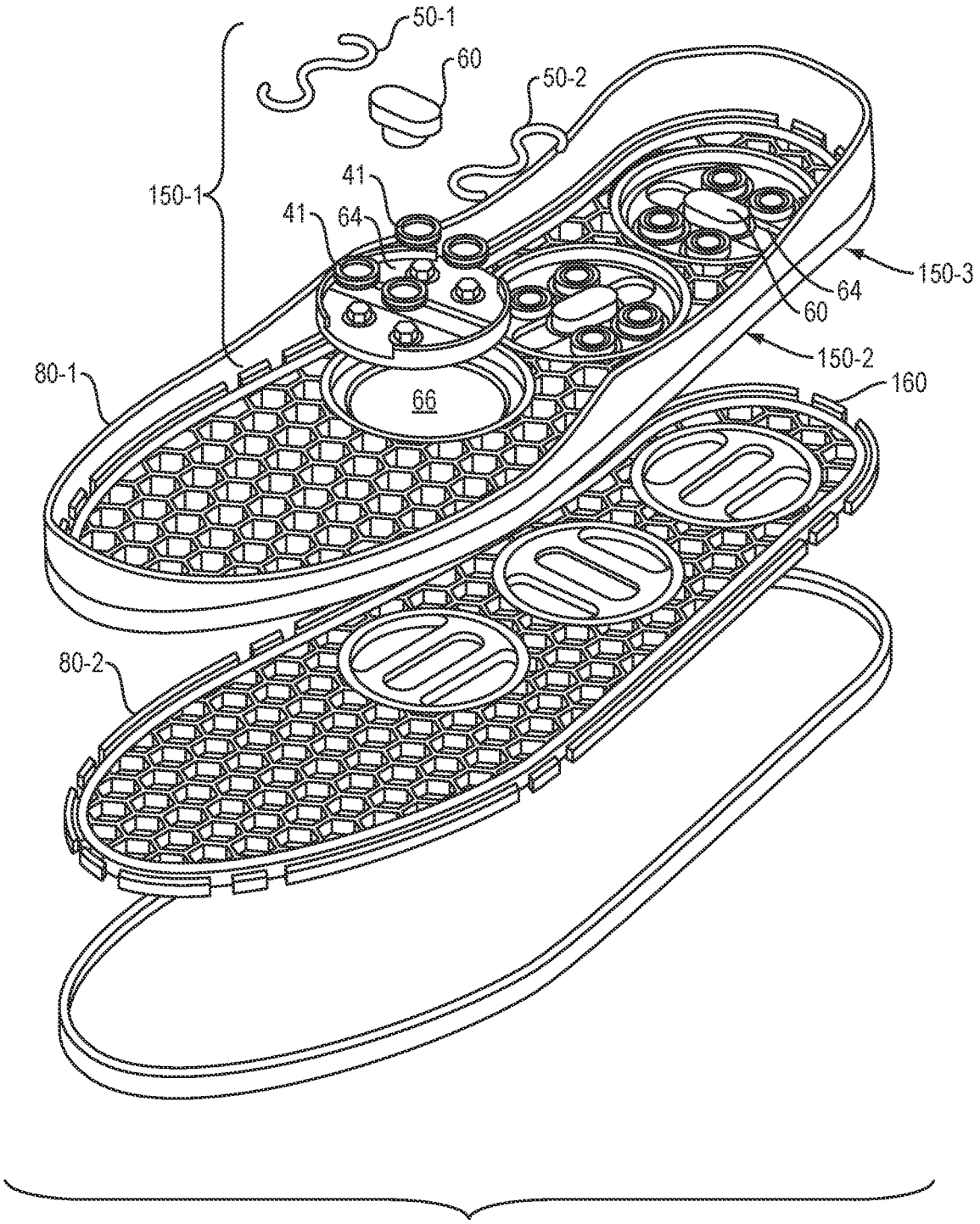
Figure 8D:
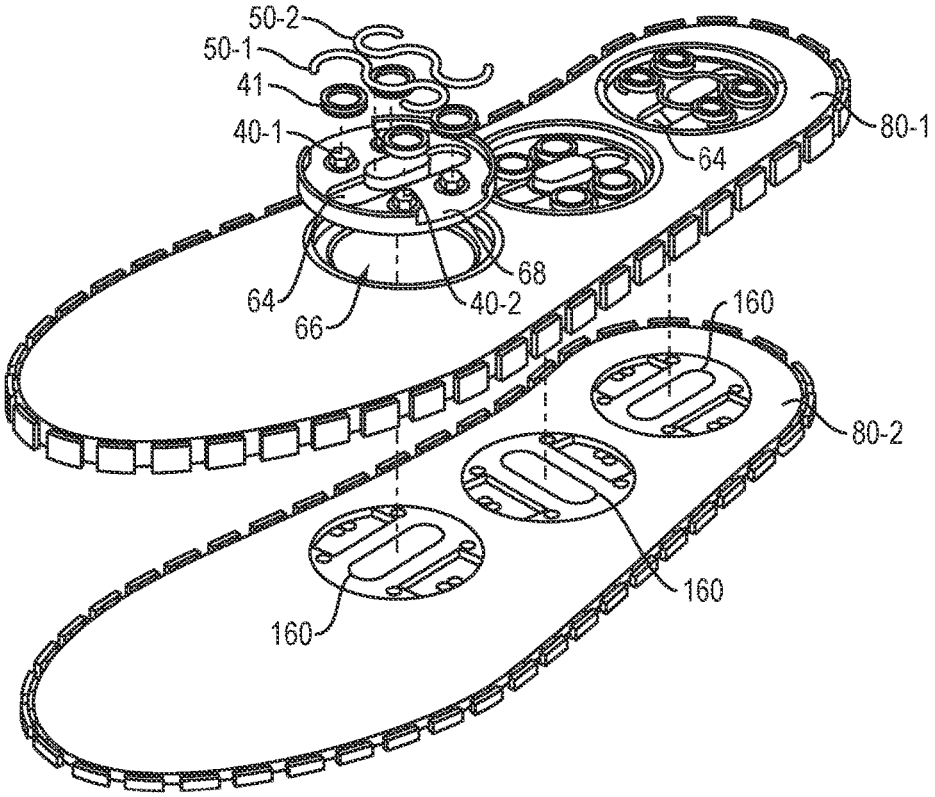

FIG. 8C shows an alternate arrangement of the force mitigating assemblies 150 with a central forward/backward force mitigating assembly 150-2, flanked by the heel 150-3 and forward mid-sole 150-1 assemblies to address lateral forces for response to twisting. The twisting response is therefore accommodated by the flanking force mitigation assemblies 150-1 and 150-3 disposing in opposed lateral directions.

The slots accommodate components (i.e. forward/lateral) of movement and are arranged perpendicularly so at least one force mitigation assembly 150 is invoked for any planar movement 360 degrees about the sole. Each elongated member, of the opposed elongated members is disposed between a pair of rigid members 40 by engaging an annular surface of the rigid members by a spiral "wrapping." An actuator 60 responsive to the received force is engaged in a slot 64 defining a path between each pair of rigid members 40. Each actuator 60 is responsive to a received force for engaging a medial section of the elongated member 50 between the corresponding rigid members, and dispose the elongated member 50 for drawing the elongated member in slideable communication along the annular surface of each of the rigid members 40.

Figure 9:
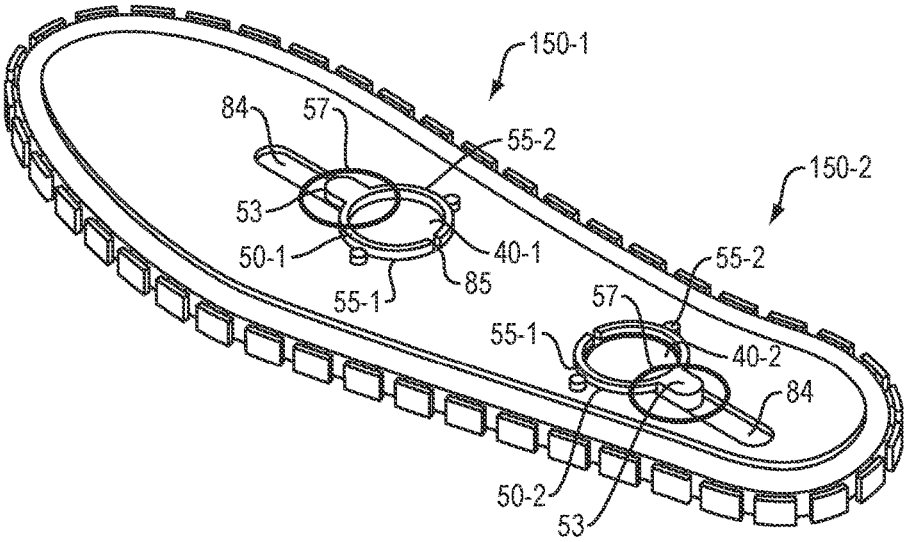
FIG. 9 shows an alternative arrangement including a force mitigation assembly directed to multiple components of movement.

FIG. 9 shows an alternative arrangement including a force mitigation assembly directed to multiple components of movement. The force mitigation assemblies of FIGS. 6A-8D each demonstrate an elongated member adapted for resilient deformability responsive along a dedicated axis. Referring to FIGS. 8A-9, FIG. 9 demonstrates an elongated member 50 defining an elastic field 42 responsive to multidimensional forces. Referring to FIG. 9, the force mitigation assembly 150 includes an elongated member 50 in the shape of a pincer having a central post 53 and opposed annular members 55-1 . . . 55-2 extending along a common plane therefrom, defined by the upper sole 80-1 and lower sole 80-2. In addition, the bottom sole 80-2 includes one or more relief slots 84 with a longitudinal dimension substantially parallel to the annular members 55. A rigid member 40-1 . . . 40-2 member extends perpendicular to the common plane and disposed between the annular members 55-1 . . . 55-2 (55 generally), as if being "pinched" by the pincer.

Continuing to refer to FIG. 9, the central post 53 couples to one of the wearer interface or the sole surface, and the rigid member 40-1 couples to the other of the wearer interface or the sole surface. In other words, the central post 53 and rigid members 40 attach to the opposed upper and lower soles 80-1 . . . 80-2 as disposed by the received force. A base 57 engages the central post 53 in a relief slot 84. The slot 64 moves with the central post 40 except in a direction defined by the rigid member 40 in the direction through the center of the rigid member 40, when the central post 53 is blocked by interference with the rigid member 40, when movement is accommodated by the relief slots 84. To accommodate, in the configuration of FIG. 9, another force mitigation assembly 150-2 is defined by an opposed cylindrical rigid member 40-2. The opposed cylindrical rigid member 40-2 is engaged by a pincer having a central post and gap in a reversed orientation, thus in the case of movement "blocking" the central post, the opposed rigid member 40 and pincer oppose the force via movement afforded from the relief slot 84.

The annular members 55 are adapted to slideably deform around the rigid member 40 in response to the received force. As shown, the rigid member 40 is cylindrical and the annular members are substantially semicircular for simultaneously engaging a circumference of the rigid member, the annular members defining an arc around the circumference and terminating at a gap or slot 85 opposed from the central post 53 from which the annular members 55 extend.

In contrast to the approach of FIGS. 6A-8D, the elongated members 50-1 . . . 50-2 of FIG. 9 absorbs forces from a wider range of directions. In general, left and right lateral forces, and either forward or backward forces will resiliently deform the elongated member 150. Forces that dispose the central post 53 against the rigid member 40 can be mitigated by an opposed elongated member 150-2. This configuration includes an opposed cylindrical rigid member 40-2, such that the opposed cylindrical rigid member 40-2 is engaged by a pincer having a central post and gap or slot 84 in a reversed orientation. 360 degree force mitigation can therefore be achieved with fewer force mitigation assemblies 150.

Figure 10A:
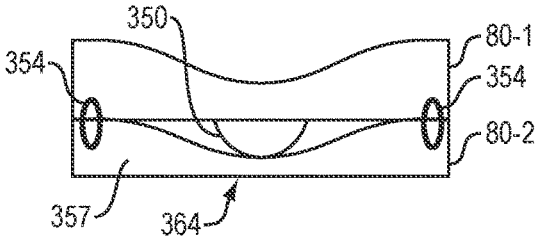
FIGS. 10A-10B show an elastic field for centering a split sole implementation in the configurations above.
Figure 10B:
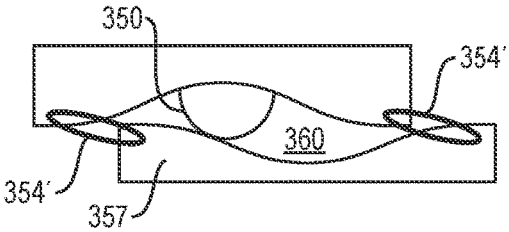

It is conceivable that the force mitigation assemblies may impose a tolerance between the elongated members 50, rigid members 40 and other elements. FIGS. 10A and 10B show an elastic field for centering a split sole implementation in the configurations above. A centering element 350 resides in a recession 360 in a "dimpled" arrangement between the upper 80-1 and lower 80-2 sole surfaces. An inclined surface 352 serves to keep the centering element 350 in the recession 360 until disposed by lateral or forward/backward forces, and is assisted by resilient tethers 354 or bands to bias a centered arrangement. FIG. 10B shows a displaced centering element 350 slideably disposed up the inclined surface 352, while stretched tethers 354' impose tension for returning to a centered position. Variance of the recession size and the inclined plane can impart a centering bias between the upper 80-1 and lower 80-2 soles to maintain firm control to moderate forces.

Figure 11:
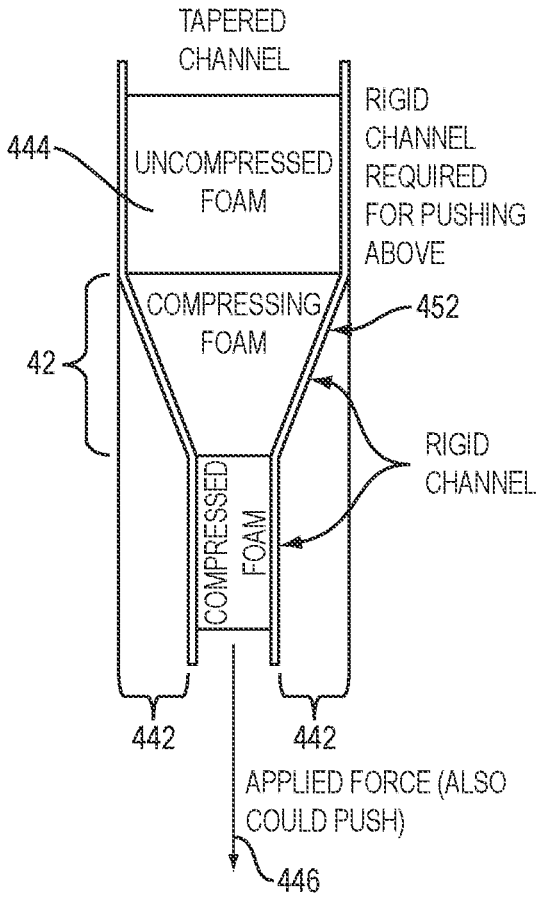
FIG. 11 shows an inclined plane approach to constant force elastic field force mitigation.
Figure 12A:
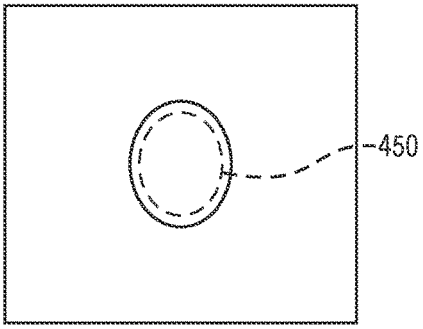
FIGS. 12A-12D show a force mitigation assembly as in FIG. 11 in a split sole configuration.
Figure 12B:
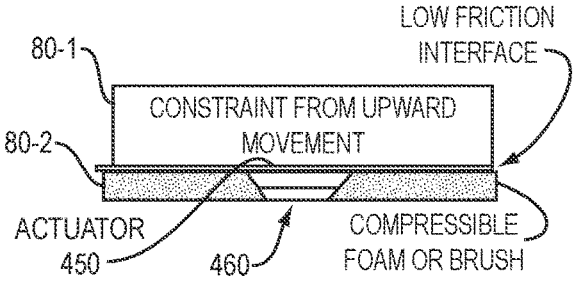
Figure 12C:
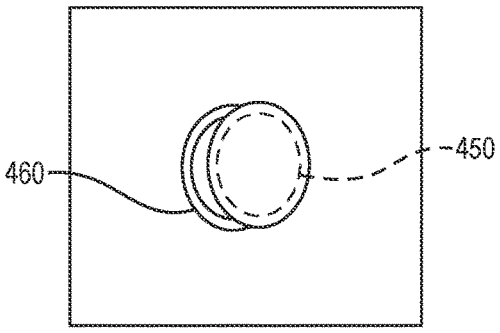
Figure 12D:
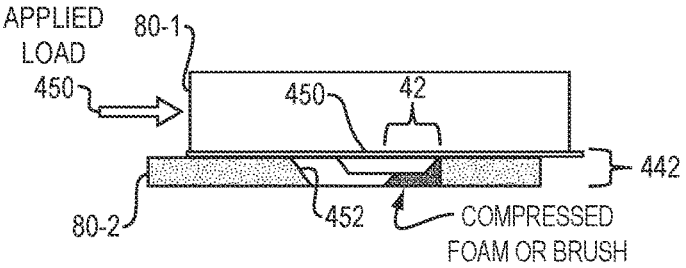

FIG. 11 shows an inclined plane approach to constant force elastic field force mitigation. Referring to FIGS. 10A-11, an elastic field 42 is defined by a resilient and/or deformable material such as compressible foam that forma a deformation member 444. Compression or deformation of the material in the elastic field generates a constant resistance or spring-like force defined by the size of the elastic field. The force mitigation assembly 150 further comprising a tapered region 442 defined by an inclined surface 452. The elastic field 42 includes a portion of the deformation member 444 in the tapered region 442 where the deformation member 444 undergoes compression. The tapered region 442 therefore has an area of greater cross section and an area of reduced cross section metered by the inclined surface 452. The deformation member 44 disposed in the tapered region and is adapted to be disposed from the area of greater cross section to the area of reduced cross section in response to the received force 446. By keeping the elastic field size constant, the reactive force (to the applied force 446) is also constant. Thus, as the uncompressed foam defining the deformation member 444 is pulled through a rigid channel against the inclined surface 452, a constant reactive force results.

FIGS. 12A-12D shows a force mitigation assembly as in FIGS. !0A-B and 11 in a split sole configuration. Referring to FIGS. 10A-12D, a resilient member 450 resides in a circumferential recession 460 surrounded by an inclined surface 452. The resilient member 450 adheres to the upper sole 80-1, and the recession 460 is in the lower sole 80-2. The tapered region 442 is defined by a cavity having at least one inclined surface 452 in slideable communication with the resilient member 450 for compression in response to the received force direction 46.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A force dissipating device adapted for a footwear appliance, comprising:

a linkage attached to a footwear upper sole defining a wearer interface for receiving forces based on activity of the wearer;

an attachment to a lower sole defining a sole surface for receiving ground forces transmitted from frictional contact between the sole surface and a ground surface against which the footwear appliance is disposed;

a force mitigation assembly in communication between the linkage and the attachment for absorbing force received from the sole surface and directing the received force to the linkage in a controlled manner; and an elastic field in the force mitigation assembly, the elastic field defined by an elongated member of a resilient material adapted to deform in response to the received force, the resilient material disposed against a rigid member in the force mitigation assembly, the response to the received force based on a deformation section formed from a length of the elongated member engaged with the rigid member, the elongated member exerting a counterforce against the deformation; the elongated member having an annular rest position slideably engaging flanking rigid members extending from either the sole surface or the wearer interface, the force mitigation assembly further comprising:

an actuating rigid member between the flanking rigid members and attached to the other of the sole surface or the wearer interface;

an annular rest position disposing the elongated member circumferentially engaged around the flanking rigid members; and a coupling between the actuating rigid member and the elongated member and responsive to the received force for deforming the elongated member out of circumferential engagement with the flanking rigid members.

2. The device of claim 1 wherein the attachment receives lateral forces between the upper sole and lower sole substantially parallel to the ground surface during contact of the ground surface with the sole surface.

3. The device of claim 1 wherein the rigid member extends substantially perpendicular from the sole surface, the elongated member coupled to the linkage for receiving the movement based on activity of the wearer.

4. The device of claim 1 wherein the elastic field includes the deformation section in contact with the rigid member, the segment having a length, the length remaining substantially constant during contact with the rigid member.

5. The device of claim 1 wherein the elongated member is a homogeneous material with a solid cross section.

6. The device of claim 1 wherein the elastic field includes a deformation member and the force mitigation assembly further comprising a tapered region;

the tapered region having an area of greater cross section and an area of reduced cross section;

the deformation member disposed in the tapered region and adapted to be disposed from the area of greater cross section to the area of reduced cross section in response to the received force.

7. The device of claim 6 wherein the tapered region is defined by a cavity having at least one inclined surface, the inclined surface in slideable communication with the deformation member for compression in response to the received force.

8. The device of claim 1 wherein the force mitigation assembly further comprises:

a pincer having a central post and opposed annular members extending along a common plane therefrom; and a rigid member extending perpendicular to the common plane and disposed between the annular members;

the central post coupled to one of the wearer interface or the sole surface, and the rigid member coupled to the other of the wearer interface or the sole surface;

the annular members adapted to slideably deform around the rigid member in response to the received force.

9. The device of claim 8 wherein the rigid member is cylindrical and the annular members are substantially semicircular for simultaneously engaging a circumference of the rigid member, the annular members defining an arc around the circumference and terminating at a gap opposed from the central post from which the annular members extend.

10. The device of claim 1 further comprising a plurality of rigid members, each rigid member extending from the lower sole, the elongated member engaging each of the rigid members and biased in a rest position around at least one of the engaged rigid members, the elongated member adapted to slideably deform from the respective rest position in response to the received force.

11. A force dissipating device adapted for a footwear appliance, comprising:

a linkage attached to a footwear upper sole defining a wearer interface responsive to movement based on activity of the wearer;

an attachment to a lower sole defining a sole surface for receiving ground forces transmitted from frictional contact between the sole surface and a ground surface against which the footwear appliance is disposed;

a force mitigation assembly in communication between the linkage and the attachment for absorbing force received from the sole surface and directing the received force to the linkage in a controlled manner;

an elastic field in the force mitigation assembly, the elastic field defined by an elongated member of a resilient material adapted to deform in response to the received force; and a plurality of rigid members, each rigid member extending from the upper sole, the elongated member engaging each of the rigid members and biased in a rest position around at least one of the engaged rigid members, the elongated member adapted to slideably deform from the respective rest position in response to the received force.

12. A force dissipating device adapted for a footwear appliance, comprising:

a linkage attached to a footwear upper sole defining a wearer interface responsive to movement based on activity of the wearer;

an attachment to a lower sole defining a sole surface for receiving ground forces transmitted from frictional contact between the sole surface and a ground surface against which the footwear appliance is disposed;

a force mitigation assembly in communication between the linkage and the attachment for absorbing force received from the sole surface and directing the received force to the linkage in a controlled manner; and an elastic field in the force mitigation assembly, the elastic field defined by an elongated member of a resilient material adapted to deform in response to the received force; wherein the force mitigation assembly includes opposed elongated members, each elongated member disposed between a pair of rigid members by engaging an annular surface of the rigid members; and an actuator responsive to the received force, the actuator engaged in a slot defining a path between each pair of rigid members, each actuator responsive to the received force for engaging a medial section of the elongated member, the medial section between the corresponding rigid members, and disposing the elongated member for drawing the elongated members in slideable communication along the annular surface of each of the rigid members.

13. The device of claim 12 wherein each of the opposed elongated members absorbs a component of the received force in a direction opposite to the other of the opposed elongated member.

14. The device of claim 13 wherein the slot is disposed in a rotating base and adapted to dispose in a direction corresponding to a component of the received force aligned with the slot.

15. A force dissipating device adapted for a footwear appliance, comprising:

a linkage attached to a footwear upper sole defining a wearer interface for receiving forces based on activity of the wearer;

an attachment to a lower sole defining a sole surface for receiving ground forces transmitted from frictional contact between the sole surface and a ground surface against which the footwear appliances is disposed;

a force mitigation assembly in communication between the linkage and the attachment for absorbing force received from the sole surface and directing the received force to the linkage in a controlled manner; and an elastic field in the force mitigation assembly, the elastic field defined by a resilient material adapted to deform in response to the received force, the elastic field defined by an elongated member of the resilient material, the elongated member spanning a plurality of rigid members in the force mitigation assembly and adapted to deform the resilient material in response to the received force, at least one rigid member extending from the linkage to the wearer interface, the elongated member in slidable communication with at least two of the rigid members for deformation responsive to the received force, the elongated member exerting a counterforce against the deformation;

the elongated member biased in a rest position around a perimeter of at least one of the rigid members and adapted for slideable deformation in response to the received force, the elastic field defined by a portion of the elongated member disposed around the perimeter.

* * * * *